US009638117B2

(12) United States Patent
Lent et al.

(10) Patent No.: US 9,638,117 B2
(45) Date of Patent: May 2, 2017

(54) METHOD FOR CONTROLLING AN AMOUNT OF FUEL AND VEHICLE INCLUDING SAME

(71) Applicant: Honda Motor Co., Ltd., Minato-ku, Tokyo (JP)

(72) Inventors: Stanley D. Lent, Marysville, OH (US); Joshua D. VanLandingham, Marysville, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 515 days.

(21) Appl. No.: 13/831,796

(22) Filed: Mar. 15, 2013

(65) Prior Publication Data

US 2014/0278006 A1 Sep. 18, 2014

(51) Int. Cl.

*F02D 41/00* (2006.01)
*F02D 41/24* (2006.01)
*F02D 41/30* (2006.01)

(52) U.S. Cl.

CPC ..... *F02D 41/0025* (2013.01); *F02D 41/2422* (2013.01); *F02D 41/3005* (2013.01); *F02D 2200/021* (2013.01); *F02D 2200/0611* (2013.01)

(58) Field of Classification Search

CPC .. F02D 41/0025; F02D 19/08; F02D 19/0613; F02D 19/084; F02D 19/00; F02D 19/0655; F02D 19/0694; F02D 19/06; F02D 19/0607; F02D 19/061; F02D 41/3005; F02D 41/2422; F02D 2200/021; F02D 2200/0611

USPC ..... 123/1 A, 575–578, 179.16; 701/102–105

See application file for complete search history.

(56) References Cited

U.S. PATENT DOCUMENTS

| | | | | |
|---|---|---|---|---|
| 2,199,259 | A | 4/1940 | Hersey | |
| 4,385,611 | A * | 5/1983 | Harper et al. | 123/480 |
| 4,457,134 | A | 7/1984 | Deutschmann | |
| 5,038,730 | A * | 8/1991 | Kashima | 123/179.21 |
| 5,056,490 | A * | 10/1991 | Kashima | 123/478 |
| 5,146,882 | A * | 9/1992 | Brinkman | F02D 41/062 123/1 A |
| 5,150,301 | A * | 9/1992 | Kashiwabara et al. | 701/106 |
| 5,154,058 | A | 10/1992 | Mizuno | |
| 5,179,926 | A * | 1/1993 | Ament | 123/494 |
| 5,301,648 | A * | 4/1994 | Uchinami | 123/491 |
| 5,357,927 | A * | 10/1994 | Saito et al. | 123/406.54 |
| 5,749,346 | A * | 5/1998 | Halvorson et al. | 123/486 |
| 5,908,014 | A * | 6/1999 | Leithinger | F02B 75/048 123/48 B |
| 6,684,630 | B2 | 2/2004 | Uchida et al. | |

(Continued)

FOREIGN PATENT DOCUMENTS

| | | | |
|---|---|---|---|
| JP | 5-5420 | A | 1/1993 |
| JP | 05071380 | A * | 3/1993 |

(Continued)

*Primary Examiner* — Joseph Dallo

(74) *Attorney, Agent, or Firm* — Kenealy Vaidya LLP

(57) ABSTRACT

A method is provided for operating a vehicular engine that comprises a plurality of pistons and a plurality of cylinders. The method comprises detecting an engine temperature and detecting an alcohol concentration of fuel. The method further comprises selecting an amount of fuel according to the engine temperature and the alcohol concentration and selectively dispensing the amount of fuel to the cylinders.

20 Claims, 4 Drawing Sheets

(56) References Cited

U.S. PATENT DOCUMENTS 6,715,289 B2 4/2004 Mader et al.
7,380,540 B1 6/2008 Duffy et al.
7,448,205 B2 11/2008 Takahashi et al.
7,621,126 B2 11/2009 Kolmanovsky et al.
8,165,788 B2 * 4/2012 Surnilla ..... F02D 41/0025 123/406.11
8,447,496 B2 * 5/2013 Krengel et al. ..... 701/103
8,712,669 B2 * 4/2014 Krengel et al. ..... 701/103
2007/0095331 A1 * 5/2007 Ayame ..... 123/491
2007/0119413 A1 * 5/2007 Lewis et al. ..... 123/295
2008/0072878 A1 * 3/2008 Kokubu ..... 123/486
2008/0086257 A1 * 4/2008 Iihoshi ..... F02D 41/1495 701/105
2008/0092851 A1 * 4/2008 Arakawa et al. ..... 123/445
2008/0127640 A1 * 6/2008 Morita ..... F01N 3/0814 60/301
2008/0183369 A1 * 7/2008 Kitagawa ..... F02D 37/02 701/103
2008/0216788 A1 9/2008 Henrich et al.
2008/0262702 A1 * 10/2008 Bamba ..... F02D 41/009 701/103
2009/0093941 A1 * 4/2009 Drazich ..... 701/103
2009/0159057 A1 * 6/2009 Pursifull et al. ..... 123/575
2009/0205613 A1 * 8/2009 Kawakita et al. ..... 123/406.44
2009/0248279 A1 * 10/2009 Ito et al. ..... 701/109
2010/0036587 A1 * 2/2010 Kato et al. ..... 701/103
2010/0049424 A1 * 2/2010 Tashima et al. ..... 701/103
2010/0101548 A1 * 4/2010 Ito et al. ..... 123/674
2010/0138136 A1 * 6/2010 Nagasaki et al. ..... 701/103
2010/0145596 A1 * 6/2010 Nishimura ..... 701/103
2010/0242582 A1 * 9/2010 Wang et al. ..... 73/114.62
2010/0282202 A1 * 11/2010 Luken ..... 123/184.59
2010/0294236 A1 * 11/2010 Surnilla ..... F02D 41/0025 123/304
2010/0332104 A1 * 12/2010 Griese ..... 701/102
2011/0048372 A1 * 3/2011 Dibble ..... F02D 41/0087 123/350
2011/0184629 A1 * 7/2011 Krengel et al. ..... 701/103
2011/0191006 A1 * 8/2011 Nishida et al. ..... 701/103
2011/0202259 A1 * 8/2011 Fukushima et al. ..... 701/104
2011/0203552 A1 * 8/2011 Aso et al. ..... 123/443
2011/0265764 A1 * 11/2011 Reiche et al. ..... 123/435
2011/0301828 A1 * 12/2011 Moriya et al. ..... 701/105
2011/0308501 A1 * 12/2011 Sato et al. ..... 123/520
2012/0004829 A1 * 1/2012 Bidner et al. ..... 701/103
2012/0011831 A1 * 1/2012 Neisen ..... 60/285
2012/0203443 A1 * 8/2012 Surnilla ..... F02D 41/0025 701/103
2013/0253803 A1 * 9/2013 Krengel et al. ..... 701/103

FOREIGN PATENT DOCUMENTS

JP 05195838 A * 8/1993 ..... F02D 41/02
JP 2005054771 A 3/2005
JP 2010013966 A * 1/2010
JP 2010242676 A * 10/2010

* cited by examiner

METHOD FOR CONTROLLING AN AMOUNT OF FUEL AND VEHICLE INCLUDING SAME

TECHNICAL FIELD

A vehicle includes an engine, a controller, and first and second fuel injectors. The controller is configured to facilitate operation of the first and second fuel injectors to provide an enriched air-fuel mixture.

BACKGROUND

Conventionally, when an engine is started, a controller can facilitate dispensation of an enriched air-fuel mixture to cylinders of the engine.

SUMMARY

In accordance with one embodiment, a method is provided for operating a vehicular engine that comprises a plurality of pistons and a plurality of cylinders. The method comprises detecting an engine temperature and detecting an alcohol concentration of fuel. The method further comprises selecting an amount of fuel according to the engine temperature and the alcohol concentration and selectively dispensing the amount of fuel to the cylinders.

In accordance with another embodiment, a method is provided for operating a vehicular engine that comprises a plurality of pistons and a plurality of cylinders. The method comprises detecting an engine temperature and detecting an alcohol concentration of fuel. The method further comprises providing a predetermined fuel enrichment map that defines a relationship between a fuel enrichment coefficient and an engine temperature for a range of engine timing events. The method still further comprises determining a fuel enrichment coefficient from the predetermined fuel enrichment map and operating fuel injectors according to the calculated fuel enrichment coefficient.

In accordance with yet another embodiment, a vehicle comprises an engine and a controller. The engine comprises an intake manifold, a cylinder bank, a crankshaft, a plurality of fuel injectors, an engine temperature sensor, a crankshaft position sensor, and an alcohol sensor. The intake manifold is in fluid communication with an ambient air source. The cylinder bank is in fluid communication with an output of the intake manifold and comprises a plurality of pistons and a plurality of cylinders. The crankshaft is coupled with each of the pistons. The plurality of fuel injectors are coupled with the cylinder bank and are operable to dispense fuel to the cylinders. The engine temperature sensor is configured to detect an engine temperature. The crankshaft position sensor is configured to detect at least one top center event and to generate an event signal for each top dead center event. The alcohol sensor is configured to detect an alcohol concentration of fuel. The controller is electrically coupled with the plurality of fuel injectors, the engine temperature sensor, the engine timing sensor, and the alcohol sensor. The controller comprises a predetermined fuel enrichment map. The controller is configured to facilitate operation of the fuel injectors to selectively dispense an amount of fuel according to the engine temperature and the alcohol concentration of fuel.

BRIEF DESCRIPTION OF THE DRAWINGS

Various embodiments will become better understood with regard to the following description, appended claims, and accompanying drawings wherein:

DETAILED DESCRIPTION

Figure 1:
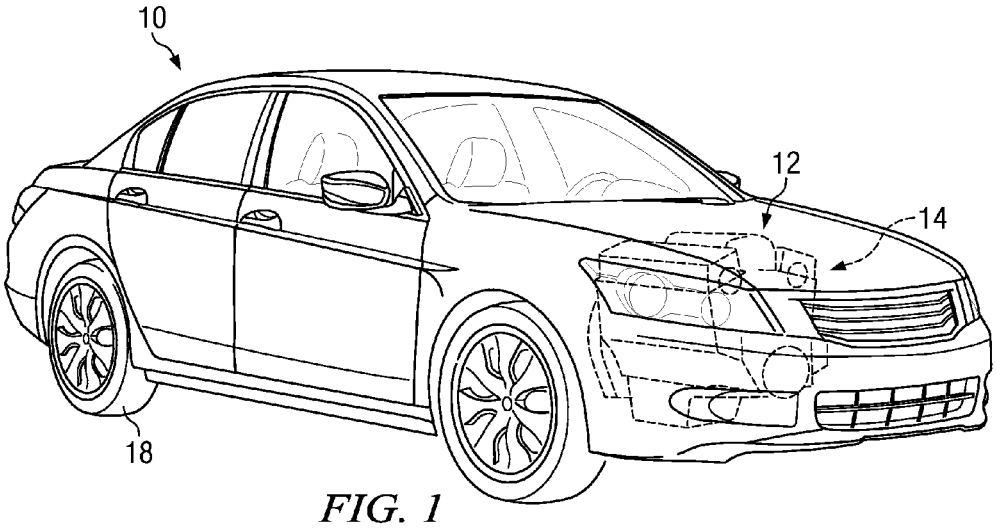
FIG. 1 is a perspective view depicting a vehicle that includes an engine.

Embodiments are hereinafter described in detail in connection with the views of FIGS. 1-5, wherein like numbers indicate the same or corresponding elements throughout the views. An engine in accordance with one embodiment can be provided in a vehicle such as, for example, an automobile, a recreational vehicle, a utility vehicle, or a water craft. In one embodiment, and as depicted in FIG. 1, a vehicle 10 can include an engine 12 that is provided within an engine compartment 14. The vehicle 10 can comprise a drivetrain (not shown) that couples the engine 12 with one or more wheels (e.g., 18) of the vehicle. The drivetrain can be coupled to the engine 12 such that power from the engine 12 can be transmitted through the drivetrain to the wheels 18 to propel the vehicle 10.

Figure 2:
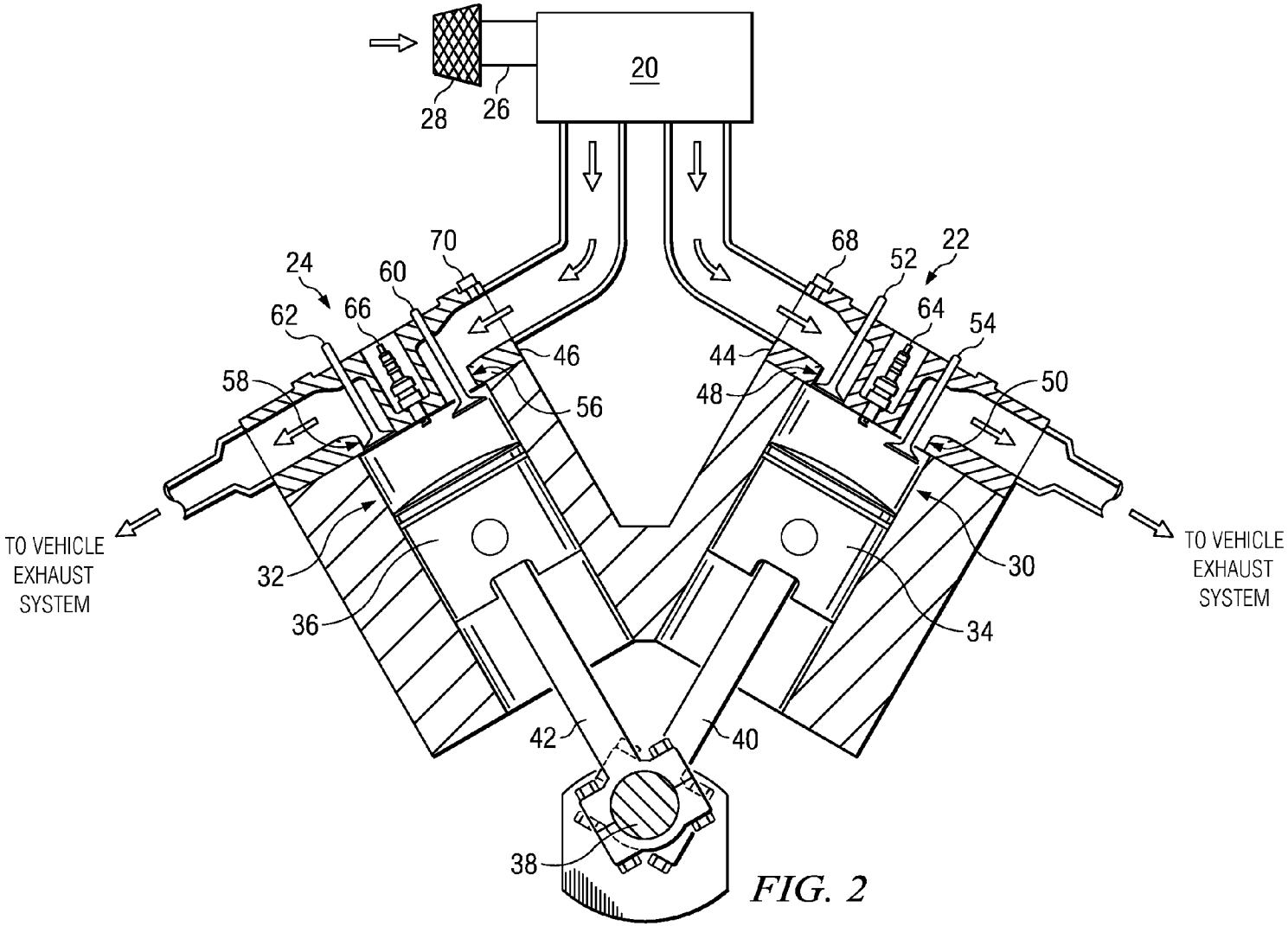
FIG. 2 is a schematic view depicting the engine of FIG. 1 having a first fuel injector and a second fuel injector associated with respective first and second cylinders.

As illustrated in FIG. 2, the engine 12 can comprise an intake manifold 20, a first cylinder bank 22, and a second cylinder bank 24. In one embodiment, the intake manifold 20 can include a flow passage 26 that permits ambient air to enter the intake manifold 20. An air filter 28 can be coupled with the flow passage 26 to facilitate filtering of the ambient air entering the intake manifold 20. As illustrated in FIG. 2, the first and second cylinder banks 22, 24 can include respective first and second cylinders 30, 32. Although the first and second cylinder banks 22, 24 are described herein with respect to individual first and second cylinders 30, 32, it will be appreciated that the first and second cylinder banks 22, 24 can each include a plurality of first and second cylinders that are similar in many respects to the respective first and second cylinders 30, 32 shown in FIG. 2 and described below. In one embodiment, the first and second cylinder banks 22, 24 can include three first cylinders 30 and three second cylinders 32 such that the engine 12 comprises a six-cylinder engine (e.g., a V-6). In other embodiments, the engine 12 can comprise a V-4, V-8, V-10, or a V-12. It will also be appreciated that the components and features of the first and second cylinder banks 22, 24 that are described below and which accommodate the individual first and second cylinders 30, 32 can be implemented for all first and second cylinders of the first and second cylinder banks 22, 24.

A first piston 34 can be disposed at least partially within the first cylinder 30 and a second piston 36 can be disposed at least partially within the second cylinder 32. The first and second pistons 34, 36 can be coupled with a crankshaft 38 via respective connecting rods 40, 42. Movement of the first and second pistons 34, 36 within the first and second cylinders 30, 32 can rotate the crankshaft 38. One end of the crankshaft 38 can be coupled to a crankshaft pulley (not shown). A belt or other suitable flexible transmitter (e.g., a chain) can couple various other components to the crankshaft 38 to facilitate powering of the components by the crankshaft 38. The other end of the crankshaft 38 can be coupled with the drivetrain.

Figure 3:
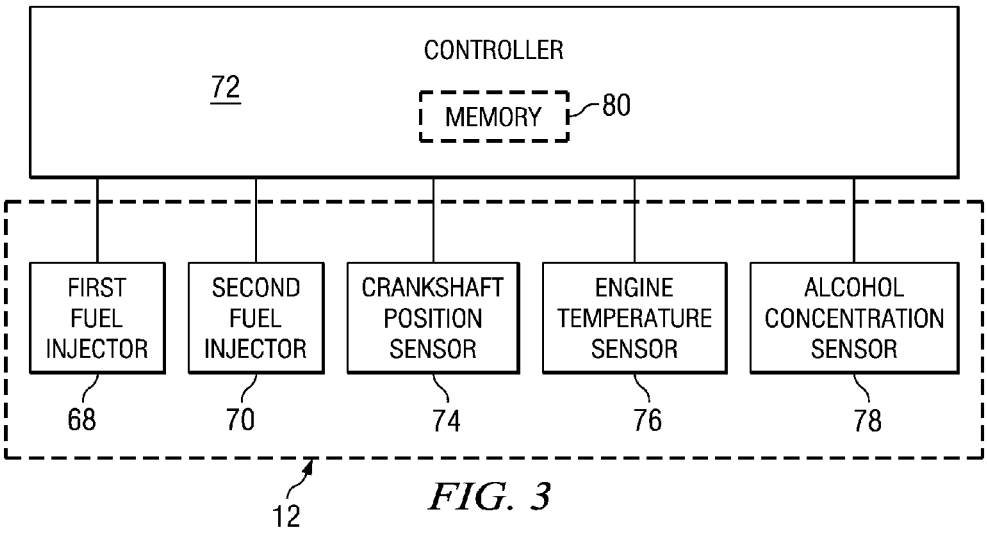
FIG. 3 is a block diagram depicting a controller in electrical communication with the engine.

As illustrated in FIG. 3, the first and second cylinder banks 22, 24 can include respective first and second valve bodies 44, 46. The first valve body 44 can define an intake port 48 and an exhaust port 50 that are in fluid communication with the first cylinder 30. An intake valve 52 and an exhaust valve 54 can be associated with the intake port 48 and the exhaust port 50, respectively. The intake valve 52 can be movable between an opened position and a closed position (closed position shown in FIG. 2) to facilitate selective transmission of fluid from the intake port 48 into the first cylinder 30. The exhaust valve 54 can be movable between an opened position and a closed position (opened position shown in FIG. 2) to facilitate selective transmission of fluid from the first cylinder 30 to the exhaust port 50. The intake and exhaust valves 52, 54 can be movable between their respective opened and closed positions through operation of a camshaft (not shown) that can be coupled with the crankshaft 38 (e.g., with a belt).

The second valve body 46 of the second cylinder bank 24 can be similar in many respects to the first valve body 44, but instead associated with the second cylinder 32. For example, the second valve body 46 can define an intake port 56 and an exhaust port 58 that are in fluid communication with the second cylinder 32. An intake valve 60 and an exhaust valve 62 can be associated with the intake port 56 and the exhaust port 58, respectively. The intake and exhaust valves 60, 62 can be movable between respective opened and closed positions through operation of a camshaft (not shown) that can be coupled with the crankshaft 38 (e.g., with a belt).

The engine 12 can include a fuel delivery system that is associated with the first and second cylinders 30, 32. The fuel delivery system can be operable to supply fuel to the first and second cylinders 30, 32, respectively. The engine 12 can also include first and second spark plugs 64, 66 that can be operable to ignite fuel supplied to the first and second cylinders 30, 32, respectively. In one embodiment, as illustrated in FIG. 2, the fuel delivery system can include first and second fuel injectors 68, 70. The first and second fuel injectors 68, 70 can be coupled with a fuel rail that is in fluid communication with the vehicle's fuel system (e.g., fuel pump). The first fuel injector 68 can be coupled with the first valve body 44 such that it is associated with the intake port 48.

The first spark plug 64 can be coupled with the first valve body 44 such that the first spark plug 64 extends at least partially into the first cylinder 30. With the intake valve 52 opened and the exhaust valve 54 closed, the first fuel injector 68 can supply fuel (e.g., gasoline) to the first cylinder 30. Once the intake valve 52 closes, the first spark plug 64 can ignite the fuel to facilitate downward movement of the first piston 34 which results in rotation of the crankshaft 38. The exhaust valve 54 can then open to permit exhaust fluid to discharge through the exhaust port 50 (e.g., during an exhaust stroke of the first piston 34). The second spark plug 66 and the second fuel injector 70 can be similar in many respects to the first spark plug 64 and the first fuel injector 68, but associated with the second cylinder 32. In other embodiments, the fuel system and the spark plugs can be provided in any of a variety of suitable alternative configurations that facilitate supply and ignition of fuel for cylinders of an engine. For example, the fuel system can alternatively comprise a carburetor. It will be appreciated that fuel in a cylinder can alternatively be ignited without an ignition device such as through compression (e.g., a diesel engine).

As illustrated in FIG. 3, a controller 72 can be associated with the engine 12. The controller 72 can comprise an engine control unit (ECU), a power-train control module (PCM), an engine control module (ECM), or any of a variety of suitable alternative controllers for controlling operation of the engine 12. The controller 72 can be electrically coupled with the first and second spark plugs 64, 66 and the first and second fuel injectors 68, 70. During operation of the engine 12, the controller 72 can facilitate operation of the first and second spark plugs 64, 66 and the first and second fuel injectors 68, 70 to facilitate combustion of fuel within the first and second cylinders 30, 32.

Operation of the first and second fuel injectors 68, 70 can dispense fuel to the first and second cylinders 30, 32, respectively. When fuel is present within the first and second cylinders 30, 32, the controller 72 can actuate the first and second spark plugs 64, 66 (e.g., during respective compression strokes of the first and second pistons 34, 36) to ignite the fuel. The controller 72 can control the ignition timing of the first and second spark plugs 64, 66 to facilitate effective combustion of the fuel within the first and second cylinders 30, 32.

In one embodiment, the controller 72 can facilitate operation of the first and second spark plugs 64, 66 according to the position of the first and second pistons 34, 36. In such an embodiment, the controller 72 can be coupled with a crankshaft position sensor 74. During operation of the engine 12, the controller 72 can detect the position of the first and second pistons 34, 36 as a function of the position of the crankshaft 38 and, when the position of the first and second pistons 34, 36 is appropriate for ignition (e.g., 12 degrees from top dead center), the controller 72 can actuate the respective first and second spark plugs 64, 66 to ignite the fuel within the respective first and second cylinders 30, 32. It will be appreciated that the controller 72 can control the ignition timing of the first and second spark plugs 64, 66 to achieve effective fuel efficiency, engine power, and/or engine longevity, for example.

The controller 72 can also control the amount of fuel dispensed from the first and second fuel injectors 68, 70 to facilitate effective combustion of the fuel within the first and second cylinders 30, 32. In one embodiment, the first and second fuel injectors 68, 70 can comprise pulse-width actuated fuel injectors. In such an embodiment, the controller 72 can control the height and width of a signal pulse to the first and second fuel injectors 68, 70 to control the amount of fuel dispensed to the first and second pistons 34, 36, respectively. In another embodiment, the first and second fuel injectors 68, 70 can comprise variable orifice fuel injectors. In such an embodiment, the controller 72 can control the orifice size of each of the first and second fuel injectors 68, 70 to control the amount of fuel dispensed to the first and second cylinders 30, 32, respectively.

The amount of fuel dispensed from the first and second fuel injectors can be controlled to achieve an appropriate air-fuel mixture during operation of the engine 12. In one embodiment, the controller 72 can control the amount of fuel dispensed from the first and second fuel injectors 68, 70 to achieve a nominal air-fuel mixture (e.g., an air to fuel ratio of about 14.7 to 1). Operation of the engine 12 at the nominal air-fuel mixture can facilitate effective combustion of fuel within the first and second cylinders 30, 32 and can accordingly achieve effective fuel efficiency, engine power, and/or engine longevity, for the engine 12. When the rotational speed of the engine 12 changes, the controller 72 can change the amount of fuel accordingly to maintain the nominal air-fuel mixture. For example, as the engine throttle is increased, the controller 72 can increase the amount of the fuel that is dispensed from the first and second fuel injectors 68, 70 to maintain the nominal air-fuel mixture.

When the engine 12 is started, such as when a user operates an ignition switch, the controller 72 can control the amount of fuel dispensed from the first and second fuel injectors to provide an enriched air-fuel mixture to the first and second cylinders 30, 32 (e.g., a start fuel enrichment strategy). The enriched air-fuel mixture can continue to be provided to the first and second cylinders 30, 32 immediately after starting of the engine 12 (e.g., during operation of the engine 12). The enriched air-fuel mixture can have a lower air-to-fuel ratio than the nominal air-fuel mixture which can facilitate effective operation of the engine 12 during startup and immediately after engine startup. For example, the enriched air-fuel mixture can burn at a higher temperature than a nominal air-fuel mixture which can reduce the effects of cold starting the engine 12 (e.g., stalling and/or stuttering). However, continuous operation of the engine 12 with the enriched air-fuel mixture can affect overall operation of the engine 12. Therefore, once the engine 12 is started, the controller 72 can gradually reduce the amount of fuel dispensed from the first and second fuel injectors 68, 70 until the nominal air-fuel mixture is achieved.

In one embodiment, when the engine 12 is started, the controller 72 can facilitate dispensation of an initial amount of fuel from the first and second fuel injectors 68, 70 and can reduce subsequent amounts of fuel according to an event signal and until the nominal air-fuel mixture is achieved. For example, the crankshaft position sensor 74 can be configured to generate an event signal that indicates a top dead center (TDC) event for the first and second cylinders 36, 38. Each time the top dead center event occurs, the controller 72 can reduce the amount of the fuel in response to the event signal. In one embodiment, the crankshaft position sensor 74 can be configured to generate an event signal when each one of the first and second cylinders 36, 38 reaches TDC. In another embodiment, the crankshaft position sensor 74 can be configured to generate an event signal when only one of the cylinders (e.g., 36, 38) reaches TDC (e.g., an engine TDC). Although the event signal is described with respect to a crankshaft position sensor, it will be appreciated that the controller can reduce the amount of fuel in response to an event signal from any of a variety of suitable alternative engine timing sensors.

In one embodiment, the controller 72 can select the initial amount of fuel for the enriched air-fuel mixture according to an engine temperature and an alcohol concentration of the fuel. In such an embodiment, the initial amount of fuel for the startup air-fuel mixture can be inversely proportional to the engine temperature and/or proportional to the alcohol concentration of the fuel to effectively overcome the effects of cold starting the engine 12.

As illustrated in FIG. 3, the controller 72 can be electrically coupled with an engine temperature sensor 76 that is configured to detect a temperature of the engine 12. In one embodiment, the engine temperature sensor 76 can comprise a coolant sensor that is in fluid communication with a cooling system of the engine 12. In such an embodiment, the engine temperature sensor can detect the temperature of coolant (e.g., ethylene glycol). In another embodiment, the engine temperature sensor 76 can comprise an infrared-type sensor that can indirectly measure the temperature of the cooling system or other vehicle component with an infrared signal. In other embodiments, the engine temperature sensor 76 can comprise any of a variety of other suitable temperature sensors for measuring a coolant temperature or vehicle condition indicative of engine temperature (e.g., engine block temperature).

As illustrated in FIG. 3, the controller 72 can also be coupled with an alcohol concentration sensor 78. The alcohol concentration sensor 78 can be configured to detect an alcohol concentration of the fuel (KAC), such as, for example, to detect the ethanol amount in an ethanol-gasoline fuel blend (e.g., E10, E20, E40, E60, or E85). In one embodiment, the alcohol concentration sensor 78 can comprise an alcohol detector that is in fluid communication with the fuel system of the engine 12. In another embodiment, the alcohol concentration sensor 78 can be implemented as on-board alcohol detection software loaded on the controller 72. In such an embodiment, the controller 72 can detect the alcohol concentration of the fuel (KAC) from a variety of vehicular conditions and without any need for a physical sensor. In other embodiments, the alcohol concentration sensor 78 can comprise any of a variety of suitable devices for detecting an alcohol concentration of fuel.

In one embodiment, when the engine 12 is started, the controller 72 can control the amount of fuel dispensed from the first and second fuel injectors 68, 70 for the enriched air-fuel mixture according to a fuel enrichment map. The fuel enrichment map can provide a plurality of fuel enrichment coefficients (KFE). The amount of fuel dispensed from the first and second fuel injectors 68, 70 for the enriched air-fuel mixture can be controlled according to the value of the fuel enrichment coefficients (KFE). For example, when the fuel enrichment coefficient (KFE) is equal to 1, the amount of fuel dispensed from the first and second fuel injectors 68, 70 can be controlled to achieve a nominal air-fuel mixture. When the fuel enrichment coefficient (KFE) is greater than 1, the amount of fuel dispensed from the first and second fuel injectors 68, 70 can achieve an enriched air-fuel mixture. When the fuel enrichment coefficient (KFE) is less than 1, the amount of fuel dispensed from the first and second fuel injectors 68, 70 can achieve a lean air-fuel mixture. It will be appreciated that the amount of fuel dispensed from the first and second fuel injectors 68, 70 for the enriched and lean air-fuel mixtures can be proportional to the magnitude of the fuel enrichment coefficient (KFE) (i.e., the air-to-fuel ratio is inversely proportional to the magnitude of the fuel enrichment coefficient (KFE)).

Figure 4:
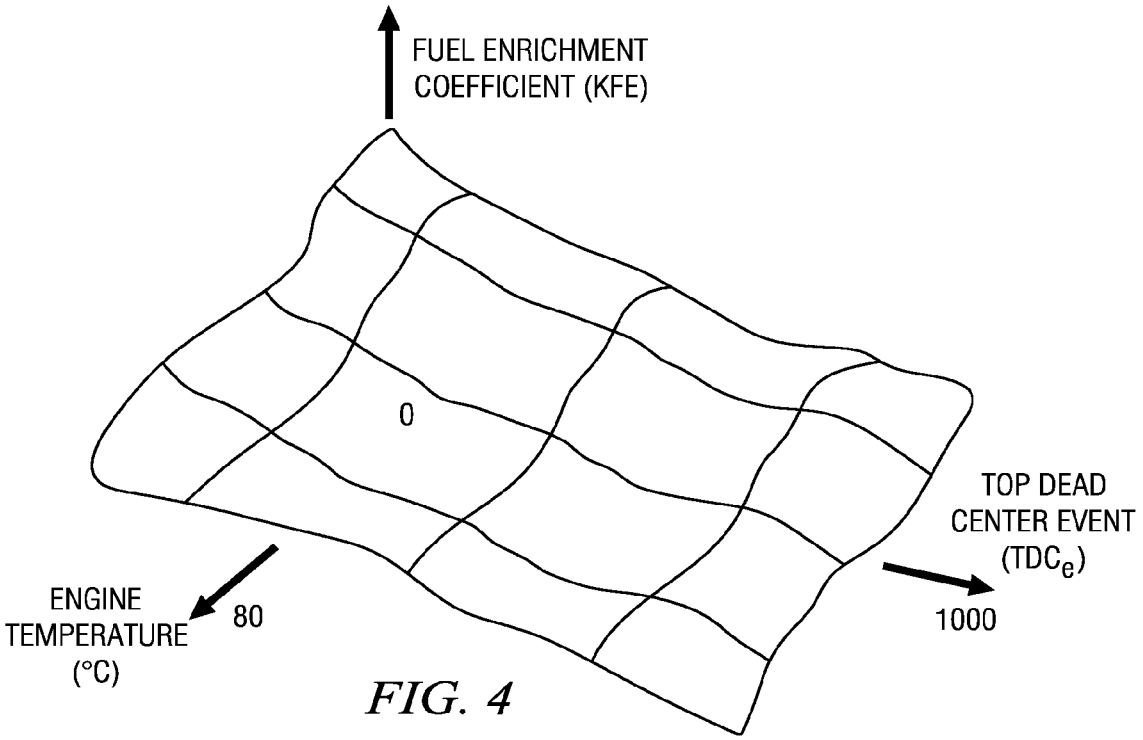
FIG. 4 is a graph depicting the relationship between a fuel enrichment coefficient (KFE) and an engine temperature for a range of top dead center events (TDCe)

As illustrated in FIG. 4, the fuel enrichment map can define a relationship between the fuel enrichment coefficient (KFE) and the engine temperature for a range of top dead center events (TDCe). As will be described in further detail below, the fuel enrichment map can correspond to the detected alcohol concentration. When the engine 12 is started, the controller 72 can detect the engine temperature (e.g., from the engine temperature sensor 76). The controller 72 can select an initial fuel enrichment coefficient (KFE) based upon the engine temperature for a TDCe value of 1. When the first top dead center event is detected, the controller 72 can facilitate dispensation of an initial amount of fuel for the enriched air-fuel mixture according to the initial fuel enrichment coefficient (KFE). As the engine 12 continues to operate, the controller 72 can reduce the amount of fuel for the enriched air-fuel mixture according to the fuel enrichment map. For example, each time a TDC event occurs, the controller can select a new value for the fuel enrichment coefficient (KFE) until the fuel enrichment coefficient (KFE) reaches a threshold value (e.g., KFE=1). When the fuel enrichment coefficient (KFE) reaches the threshold value, the amount of fuel dispensed from the first and second fuel injectors 68, 70 can facilitate operation of the engine 12 at the nominal air-fuel ratio, as described above. It will be appreciated that use of a fuel enrichment map as described above can provide variability and selectability that may not be possible with conventional start fuel enrichment strategies.

In one embodiment, the controller 72 can detect an initial engine temperature when the engine 12 is started. In such an embodiment, the controller 72 can select the values of the fuel enrichment coefficient (KFE) from the fuel enrichment map according to the initial engine temperature. In another embodiment, the controller 72 can continually detect the engine temperature once the engine 12 is started. In such an embodiment, the controller 72 can select each value of the fuel enrichment coefficient (KFE) from the fuel enrichment map according to the current engine temperature.

It will be appreciated that, when the value of the fuel enrichment coefficient (KFE) is greater than one, the controller 72 can facilitate an increase to the amount of fuel dispensed from the first and second fuel injectors 68, 70 relative to a nominal fuel amount. For example, the amount of fuel dispensed by the first and second fuel injectors 68, 70 is calculated by multiplying a nominal fuel amount (e.g., the amount of fuel that is dispensed to achieve a nominal air-fuel mixture) by the fuel enrichment coefficient (KFE). In one embodiment, the nominal fuel amount can be the amount of fuel that is dispensed to the first and second cylinders 30, 32 to achieve effective idling of the engine 12 at the nominal air-fuel ratio (e.g., about 20 cubic centimeters (cc) of fuel).

In one embodiment, the amount of fuel delivered from the first and second fuel injectors 68, 70 ($Fuel_{FINAL}$) can be calculated from the following expression:

$$Fuel_{FINAL}=Fuel_{NOMINAL}\times KFE\times K_{AMBIENT}$$

where $Fuel_{NOMINAL}$ is the nominal fuel amount and $K_{AMBIENT}$ is an ambient correction factor. The ambient correction factor $K_{AMBIENT}$ can accommodate for any of a variety of ambient conditions that can affect fuel delivery such as ambient temperature, atmospheric pressure and/or humidity, for example.

In one embodiment, as shown in FIG. 3, the controller 72 can include a memory device 80. The memory device 80 can be configured to store the fuel enrichment map as a lookup table or any of a variety of other data structures. It will be appreciated that the fuel enrichment map can be predefined by an operator or a vehicle's manufacturer, and/or might alternatively change dynamically as a function of a predefined algorithm.

In one embodiment, a plurality of fuel enrichment maps can be stored upon the memory device 80. Each enrichment map can be specific to a particular alcohol fuel concentration of the fuel (KAC). For example, a five predefined fuel enrichment maps can be stored upon the memory device 80. The first predefined fuel enrichment map can be specific to an alcohol fuel concentration (KAC) of 0% (e.g., E0 fuel). The second predefined fuel enrichment map can be specific to an alcohol fuel concentration (KAC) of 10% (e.g., E10 fuel). The third predefined fuel enrichment map can be specific to an alcohol fuel concentration (KAC) of 40% (e.g., E40 fuel). The fourth predefined fuel enrichment map can be specific to an alcohol fuel concentration (KAC) of 60% (e.g., E60 fuel). The fifth predefined fuel enrichment map can be specific to an alcohol fuel concentration (KAC) of 85% (e.g., E85 fuel). In such an embodiment, when the engine 12 is started, the controller 72 can detect the alcohol concentration of the fuel (KAC). It will be appreciated that in other embodiments, more than five fuel enrichment maps or less than five fuel enrichment maps can be provided with each map being associated with any of a variety of alcohol concentrations.

The controller 72 can select from among the plurality of predefined fuel enrichment maps based upon the detected alcohol concentration of the fuel (KAC). If the alcohol fuel concentration (KAC) of the fuel does not substantially match (e.g., within 5%) the alcohol fuel concentration (KAC) of one of the predefined fuel enrichment maps, the controller 72 can be configured to interpolate a fuel enrichment map from the predefined fuel enrichment maps. For example, if the detected alcohol concentration of the fuel (KAC) is about 30%, the controller 72 can be configured to interpolate a fuel enrichment map from the second and third predefined fuel enrichment maps.

Figure 5:
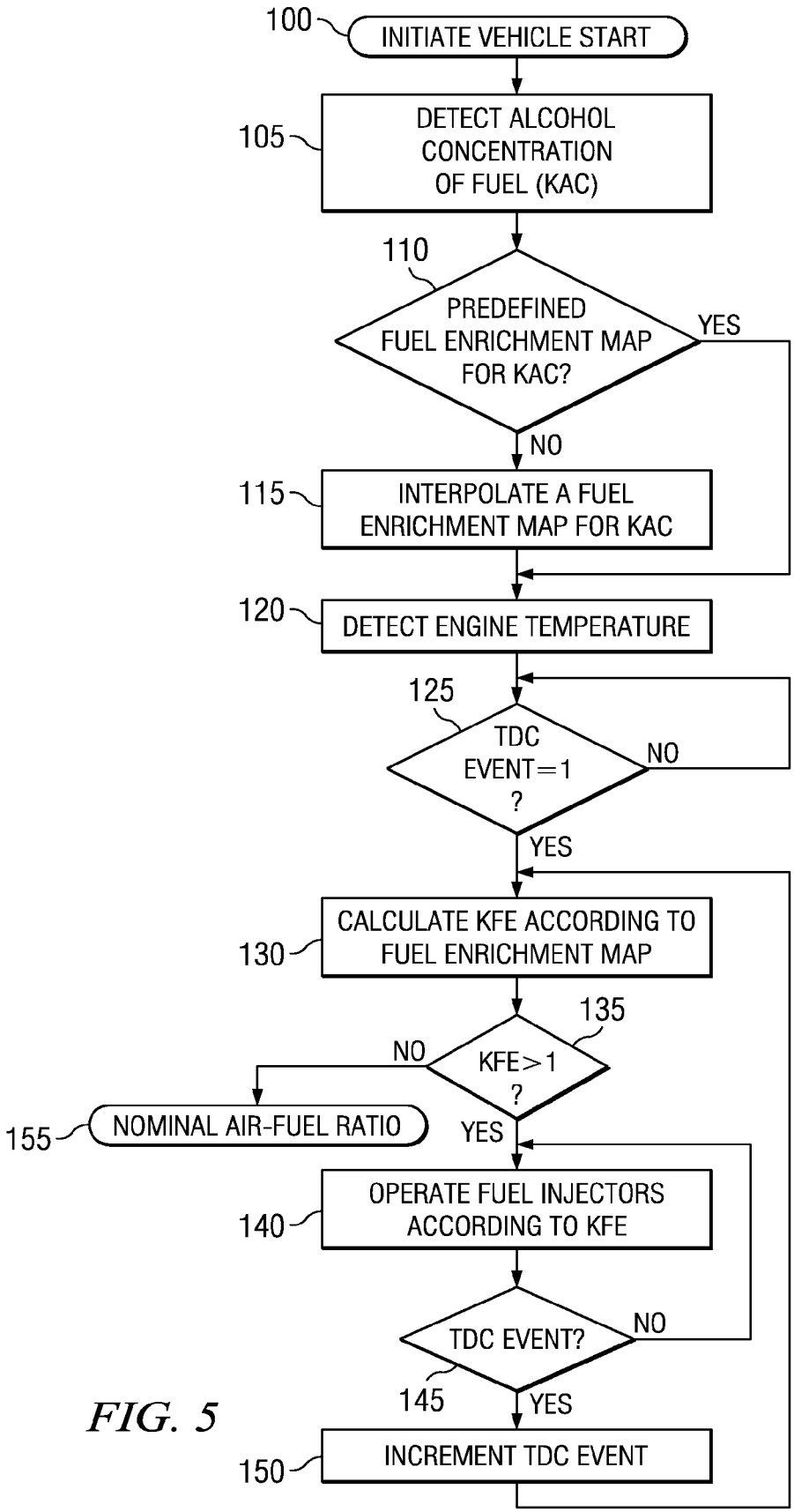
FIG. 5 depicts a control routine for a controller in accordance with one embodiment.

One embodiment of a control routine implemented by the controller 72 is generally illustrated in FIG. 5. A user can initiate starting of the vehicle 10 (100). The controller 72 can detect the detected alcohol concentration of the fuel (KAC) (105). If a predetermined fuel enrichment map exists for the detected alcohol concentration of the fuel (KAC), the controller 72 detects the engine temperature (120). If a predetermined fuel enrichment map does not exist for the detected alcohol concentration of the fuel (KAC), the controller 72 interpolates a fuel enrichment map for the detected alcohol concentration of the fuel (KAC) (115) before detecting the engine temperature (120). Once the initial TDC event is detected (125), the controller 72 can calculate the fuel enrichment coefficient (KFE) from the fuel enrichment map (130). If the fuel enrichment coefficient (KFE) is greater than 1, the controller 72 can facilitate operation of the fuel injectors (e.g., 68, 70) according to the fuel enrichment coefficient (KFE) (135). When the next TDC event (145) occurs, the TDC value can be incremented (150) and the controller 72 can calculate a new fuel enrichment coefficient (KFE) from the fuel enrichment map (130). When the fuel enrichment coefficient (KFE) reaches a value of 1, the amount of fuel dispensed from the first and second fuel injectors 68, 70 can provide operation of the engine 12 at the nominal air-fuel ratio (155).

While various embodiments of a vehicle and a method for operating a vehicular engine have been illustrated by the foregoing description and have been described in considerable detail, it is not intended to restrict or in anyway limit the scope of the appended claims to such detail. Additional modifications will be readily apparent to those skilled in the art. It is hereby intended that the scope of the invention be defined by the claims appended hereto.

What is claimed is:

1. A method for operating a vehicular engine that comprises a plurality of pistons and a plurality of cylinders, the method comprising:

detecting an engine temperature;

detecting an alcohol concentration of fuel;

selecting an amount of fuel according to the engine temperature and the alcohol concentration;

detecting each occurrence of a top dead center event of at least one of the cylinders;

providing a predetermined fuel enrichment map that defines a relationship, using three-dimensional plots, of a plurality of fuel enrichment coefficients, a plurality of engine temperatures, and a plurality of occurrences of top dead center events;

selecting one of the plurality of fuel enrichment coefficients based on each of:

one of the plurality of engine temperatures that corresponds to the detected engine temperature, the detected alcohol concentration of the fuel, and one of the plurality of occurrences of the top dead center events that corresponds to an event value indicative of the detected occurrence of the top dead center event;

determining an injection amount of fuel by multiplying the selected amount of fuel and the selected fuel enrichment coefficient; and selectively dispensing the amount of fuel to the cylinders according to the injection amount of fuel.

2. The method of claim 1, wherein the selecting one of the plurality of fuel enrichment coefficients includes generating an event signal that is indicative of the value of the detected occurrence of the top dead center event, and the selectively dispensing the amount of fuel includes reducing the amount of fuel in response to the event signal.

3. The method of claim 2 wherein reducing the amount of fuel in response to the event signal further comprises reducing the amount of fuel according to the fuel enrichment map.

4. The method of claim 3 wherein reducing the amount of fuel according to the fuel enrichment map further comprises interpolating the fuel enrichment map from a plurality of predetermined fuel enrichment maps.

5. The method of claim 4 further comprising:

selecting the predetermined fuel enrichment maps according to the alcohol concentration; and interpolating the fuel enrichment map according to the alcohol concentration.

6. The method of claim 1, further comprising:

the selecting one of the plurality of fuel enrichment coefficients includes generating a top dead center timing event signal that is indicative of the value of the detected occurrence of the top dead center event, wherein selecting the amount of fuel according to the engine temperature and the alcohol concentration further comprises:

selecting an initial amount of fuel according to the selected fuel enrichment coefficient; and reducing subsequent amounts of fuel in response to the top dead center timing event signal.

7. The method of claim 6 further comprising:

generating an initial event signal that indicates engine startup; and selecting the initial amount of fuel in response to the initial event signal.

8. The method of claim 7 further comprising reducing subsequent amounts of fuel until the amount of fuel reaches a threshold value.

9. A method for operating a vehicular engine that comprises a plurality of pistons and a plurality of cylinders, the method comprising:

detecting an engine temperature;

detecting an alcohol concentration of fuel;

selecting an amount of fuel according to the engine temperature and the alcohol concentration;

detecting each occurrence of a top dead center event of at least one of the cylinders;

providing a predetermined fuel enrichment map that defines a relationship, using three dimensional plots, between a plurality of fuel enrichment coefficients, a plurality of engine temperatures, and a plurality of occurrences of top dead center events;

determining one of the fuel enrichment coefficients from the predetermined fuel enrichment map based on each of:

one of the plurality of engine temperatures that corresponds to the detected engine temperature, the detected alcohol concentration of the fuel, and one of the plurality of occurrences of the top dead center events that corresponds to an event value indicative of the detected top dead center event;

selecting an amount of fuel according to the detected engine temperature and the detected alcohol concentration;

determining an injection amount of fuel by multiplying the selected amount of fuel and the selected fuel enrichment coefficient; and operating fuel injectors according to the injection amount of fuel.

10. The method of claim 9 further comprising detecting an initial engine timing event, and wherein operating fuel injectors according to the injection amount of fuel further comprises operating the fuel injectors according to the injection amount of fuel upon detection of the initial engine timing event.

11. The method of claim 9 wherein providing a predetermined fuel enrichment map further comprises providing a plurality of predetermined fuel enrichment maps, each predetermined fuel enrichment map being associated with an alcohol concentration value.

12. The method of claim 11 wherein providing a predetermined fuel enrichment map further comprises interpolating a fuel enrichment map from the plurality of predetermined fuel enrichment maps according to the detected alcohol concentration and wherein determining a fuel enrichment coefficient further comprises determining a fuel enrichment coefficient from the interpolated fuel enrichment map.

13. The method of claim 10 wherein determining a fuel enrichment coefficient from the predetermined fuel enrichment map further comprises determining an initial fuel enrichment coefficient from the predetermined fuel enrichment map and wherein operating the fuel injectors according to the injection amount of fuel further comprises operating the fuel injectors according to the initial fuel enrichment coefficient.

14. The method of claim 13 further comprising reducing the initial fuel enrichment coefficient according to the predetermined fuel enrichment map.

15. The method of claim 13 wherein determining a fuel enrichment coefficient from the fuel enrichment map further comprises determining subsequent fuel enrichment coefficients from the predetermined fuel enrichment map and wherein operating the fuel injectors according to the injection amount of fuel further comprises operating the fuel injectors according to the subsequent fuel enrichment coefficients.

16. A vehicle comprising:

an engine comprising:

an intake manifold in fluid communication with an ambient air source;

a cylinder bank in fluid communication with an output of the intake manifold and comprising a plurality of pistons and a plurality of cylinders;

a crankshaft coupled with each of the pistons;

a plurality of fuel injectors coupled with the cylinder bank and operable to dispense fuel to the cylinders;

an engine temperature sensor configured to detect an engine temperature;

a crankshaft position sensor configured to detect at least one top dead center event and to generate an event signal for each occurrence of the top dead center event; and an alcohol sensor configured to detect an alcohol concentration of fuel; and a controller including a memory device, and electrically coupled with the plurality of fuel injectors, the engine temperature sensor, the engine crankshaft position sensor, and the alcohol sensor, the controller comprising a predetermined fuel enrichment map, wherein the controller is configured with a predetermined fuel enrichment map that defines a relationship, using three-dimensional plots, of a plurality of fuel enrichment coefficients, a plurality of engine temperatures, and a plurality of occurrences of top dead center events, and wherein the controller is configured to:

select one of the plurality of fuel enrichment coefficients based on each of:

one of the plurality of engine temperatures that corresponds to the detected engine temperature, the detected alcohol concentration of the fuel, and one of the plurality of occurrences of top dead center events that corresponds to a value of the event signal, select an amount of fuel according to the detected engine temperature and the detected alcohol concentration;

determine an injection amount of fuel by multiplying the selected amount of fuel and the selected fuel enrichment coefficient; and operate the fuel injectors to selectively dispense an amount of fuel according to the injection amount of fuel.

17. The vehicle of claim 16 wherein the controller is configured to reduce the amount of fuel in response to the event signal and according to the predetermined fuel enrichment map.

18. The vehicle of claim 16 wherein the controller further comprises a plurality of predetermined fuel enrichment maps, the controller being configured to interpolate a fuel enrichment map from the plurality of predetermined fuel enrichment maps according to the alcohol concentration.

19. The vehicle of claim 16 wherein the engine temperature sensor comprises a coolant temperature sensor.

20. The vehicle of claim 16 wherein the controller is configured to:

determine an ambient correction factor based on at least one of ambient temperature, atmospheric pressure, and humidity; and determine the injection amount of fuel by multiplying the selected amount of fuel, the selected fuel enrichment coefficient, and an ambient correction factor.

* * * * *